US005141081A

United States Patent [19]

Kregel et al.

[11] Patent Number: 5,141,081

[45] Date of Patent: Aug. 25, 1992

[54] CARRIAGE BRAKE FOR A STORAGE AND RETRIEVAL MACHINE

[75] Inventors: Thomas P. Kregel, Whitefish Bay; Leslie K. Potter, Greendale, both of Wis.

[73] Assignee: Harnischfeger Engineers, Inc., Brookfield, Wis.

[21] Appl. No.: 597,264

[22] Filed: Oct. 15, 1990

[51] Int. Cl.[5] ..... B66B 5/18

[52] U.S. Cl. ..... 187/87; 187/77; 187/83

[58] Field of Search ..... 187/77, 78, 81, 82, 187/83, 84, 85, 86, 87, 88

[56] References Cited

U.S. PATENT DOCUMENTS

| | | | |
|---|---|---|---|
| 111,285 | 1/1871 | Weber | 187/85 |
| 675,159 | 5/1901 | Jones | 187/85 |
| 710,038 | 9/1902 | Burgart | 187/85 |
| 720,332 | 2/1903 | Day | 187/82 |
| 744,233 | 11/1903 | Read | 187/85 |
| 1,087,560 | 2/1914 | Taylor | 187/82 |
| 4,529,066 | 7/1985 | Wieschel | 187/86 |

*Primary Examiner*—Robert P. Olszewski
*Assistant Examiner*—Dean A. Reichard
*Attorney, Agent, or Firm*—Richard C. Ruppin

[57] ABSTRACT

A brake for the carriage of a storage and retrieval machine having a mast on which the carriage is mounted and on which the carriage moves in vertical directions for carrying objects to and from storage locations adjacent to the mast. A carriage drive including a rope connected to the carriage is provided for raising and lowering the carriage to and from positions adjacent the storage locations. The rope is connected under tension to the carriage and the tension is released when the rope becomes slack. The brake is mounted on the carriage and includes an actuating member and a resilient member movable into engagement with the actuating member in response to release of tension of the rope to move the actuating member along a predetermined path. The brake further includes a brake cam having an actuating section in the path of the movement of the actuating member and a toothed braking section adjacent to and spaced from the mast. The brake cam is pivotally movable into engagement with the mast along the braking section in response to engagement of the actuating section with the actuating member. As a result braking force is applied to the mast to brake the movement of the carriage.

12 Claims, 3 Drawing Sheets

CARRIAGE BRAKE FOR A STORAGE AND RETRIEVAL MACHINE

FIELD OF THE INVENTION

This invention relates to a brake for the carriage of a storage and retrieval machine and, in particular, to a brake operative in response to slack in the drive rope of a carriage movable vertically on a mast.

BACKGROUND OF THE INVENTION

Storage and retrieval machines are in wide use for storage purposes in a warehouse as well as storage of components and material as part of a manufacturing facility. Many of the storage facilities are of the automated storage and retrieval type in which the operations of a number of storage and retrieval machines and associated equipment operate in a substantially unattended manner and are directed by a remote computer. Each storage and retrieval machine typically has a base which follows a guide device along aisles between vertically arranged storage racks and a mast extending vertically upward from the base and which is positioned opposite various storage racks on different levels by the appropriate positioning of the base. A carriage is mounted on the mast and is movable upwardly and downwardly on the mast for carrying a load of material or components to and from the storage racks, and a shuttle mounted on the carriage is extendible into the storage racks to deposit or retract the load from the racks.

A common type of drive for the carriage is a rope and drum drive in which a rope or cable of a steel wire type is reeved over a sheave at the upper end of the mast and has one end attached to the carriage and has the other end attached to a rotatable drum. The drum rotates to take in or pay out the rope to raise the carriage along the mast when the rope is being taken in and lower the carriage along the mast when the rope is being payed out. If the rope breaks or detaches from the carriage, or the carriage jams during lowering movement, an emergency carriage brake is provided to hold the carriage secure on the mast and prevent its uncontrolled fall. A common type of carriage brake which has been developed for this purpose includes a toothed braking cam which is positioned adjacent to a surface of the mast and is pivotally movable into engagement with the mast to brake and hold the carriage in place on the mast. The braking cam is actuated by release of a spring held in a compressed manner by tension on the rope. When the rope goes slack due to its breakage or detachment from the carriage or jamming of the carriage, the spring mechanism will release and move the braking cam into engagement with the mast. However, the reliability of this type of carriage brake to stop and hold the carriage in an emergency situation has not been satisfactory. The problems with the cam type brake have included insufficient "biting in" of the braking teeth into the surface of the mast, the failure of the braking cam to maintain tight engagement with the mast surface, and slow engagement by the cam with the mast surface and inability of the cam to adjust for variation in the location of the mast surface. The present invention is an improvement on the cam type carriage brake and is intended to address these problems.

SUMMARY OF THE INVENTION

It is a general object of this invention to provide a brake for the carriage of a storage and retrieval machine which provides a high level of carriage stopping and holding force against the mast of the machine. It is a further object of the invention to provide a carriage brake which moves quickly to engage the mast and adjusts for variation in the position of the mast surface engaged by the brake.

The invention is carried out by providing a vertical mast mounted on the base of a storage and retrieval machine and carriage means movable in vertical directions on the mast for carrying objects to and from storage locations adjacent to the mast. Carriage drive means including a rope connected to the carriage is provided for raising and lowering the carriage to and from positions adjacent the storage locations. The rope is connected under tension to the carriage and the tension is released when the rope becomes slack. A brake is mounted on the carriage and includes an actuating member and resilient means movable into engagement with the actuating member in response to release of tension of the rope to move the actuating member along a predetermined path. The brake further includes brake cam means having an actuating section in the path of the movement of the actuating member and a toothed braking section adjacent to and spaced from the mast. The brake cam means is pivotally movable into engagement with the mast along the braking section in response to engagement of the actuating section with the actuating member as it moves along the path of the actuating member. As a result braking force is applied to the mast to brake the movement of the carriage.

The braking section has a plurality of teeth extending toward the mast. Preferably, each one of the teeth when engaged with the mast has a downward facing surface at an angle relative to the horizontal of not less than zero degrees.

The braking section may also have a first curvature portion and a second curvature portion which both engage the mast as the brake cam means pivots about the axis. The first curvature portion is positioned relative to the axis such that, during the initial pivotal movement of the brake cam means, the first curvature portion moves a distance toward the mast which is greater than the distance moved by the second curvature portion. Thereby, during the initial pivotal movement of the brake cam means, the first curvature portion moves farther during the time period of the initial pivotal movement and thereby the first curvature portion moves at a faster rate into engagement with the mast.

The brake cam means may also include a pivot pin about which the cam rotates and a slot disposed at an angle relative to the mast and through which the pivot pin extends. The slot is pivotally movable with the brake cam means toward the mast to decrease the angle. The brake cam means is responsive to the force of the mast at values of the angle of the slot which do not exceed 45 degrees to slide on the pivot pin along the slot upwardly toward the mast. Thereby the brake cam means is wedged against the mast to increase its braking action and also move an additional distance toward the mast to maintain braking engagement if the mast is positioned further away from the brake cam means than is expected.

BRIEF DESCRIPTION OF THE DRAWINGS

Further objects and advantages will appear when taken in conjunction with the accompanying drawings, in which.

DETAILED DESCRIPTION OF THE INVENTION

Figure 2:
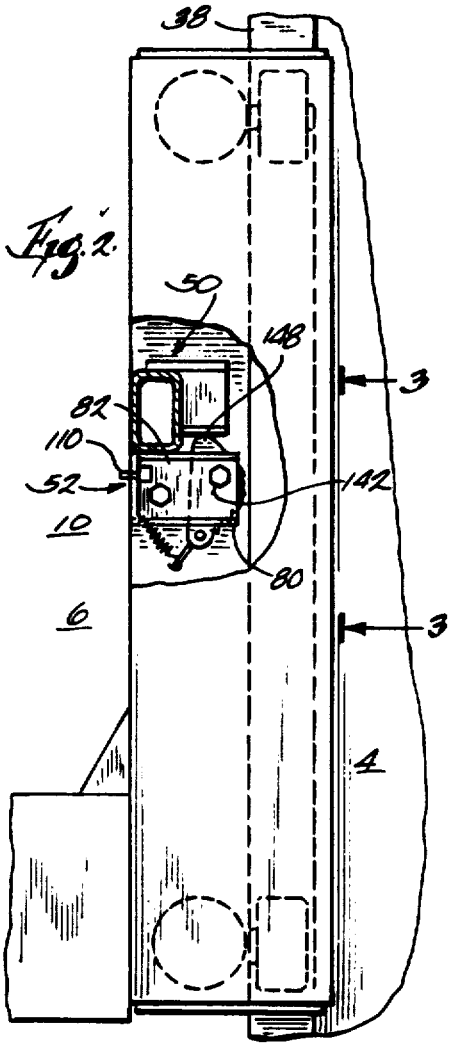
FIG. 2 is a side elevation view, partially in section, illustrating the carriage and carriage brake positioned on the mast of the storage and retrieval machine of FIG. 1.
Figure 1:
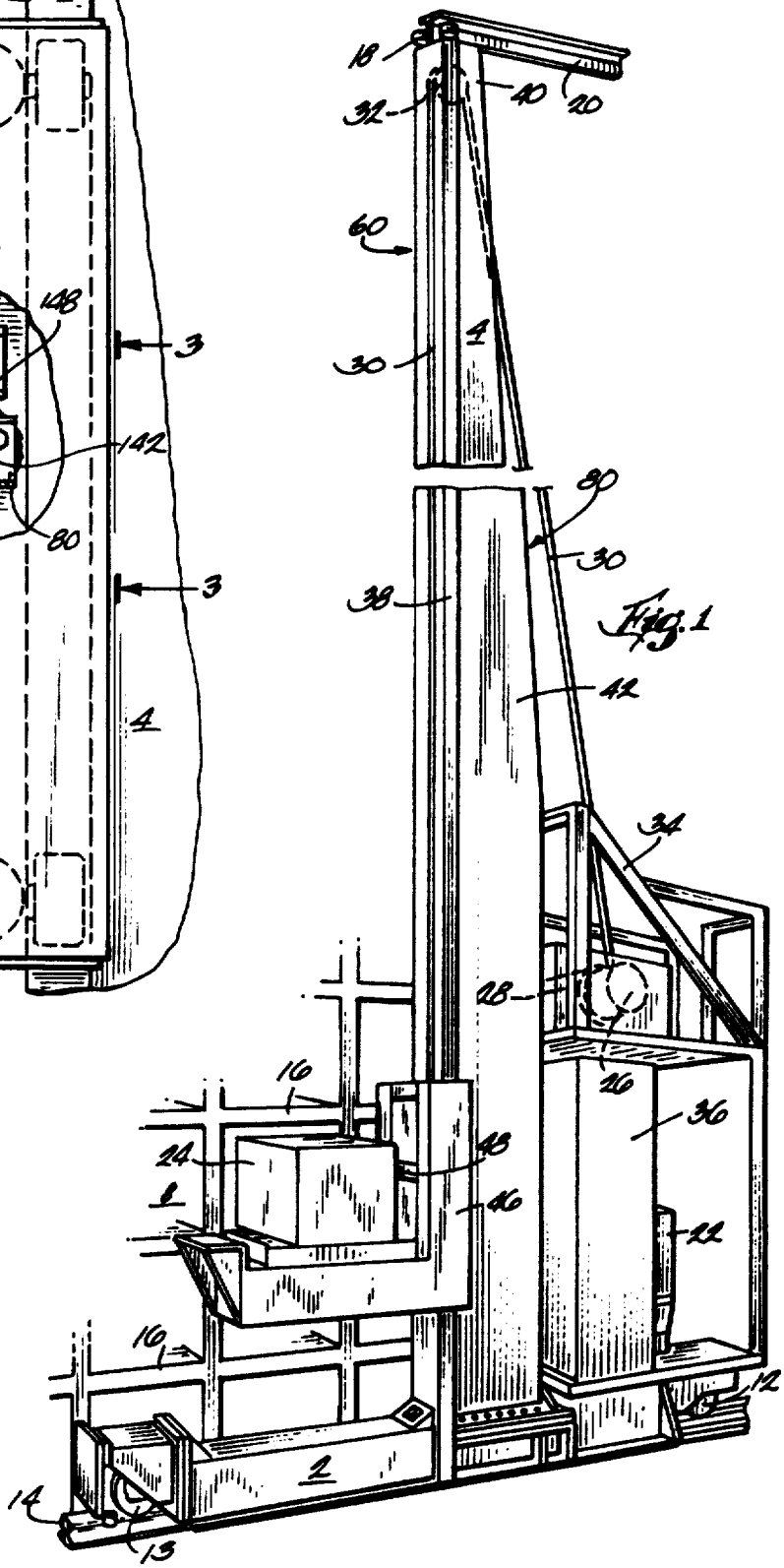
FIG. 1 is a perspective view of a storage and retrieval machine utilizing a carriage brake according to the invention.

Referring generally to FIGS. 1 and 2 of the drawings, a storage and retrieval machine is shown having a base 2, a mast 4 affixed to and extending upwardly from the base 2, a carriage 6 movable in vertical directions along the length of the mast 4 to selected positions, and a shuttle 8 mounted on the carriage 6. The mast 4 is comprised of an elongated tube member 38 and an elongated member 42. A front wheel 13 and a rear wheel 12 are mounted on the base 2 and roll along a rail 14 running through an aisle path 44 in a storage area such as a warehouse having stacked storage racks 16. Upper guide wheels 18 on the upper end 40 of the mast 4 engage an upper guide rail 20 to guide the storage and retrieval machine along the rail 14 and maintain the machine in an upright position. A motor 22 mounted on the base 2 drives the rear wheel 12 so that the storage and retrieval machine travels along the rail 14 to selected positions in the aisle path 44 adjacent to the stacked storage racks 16.

At each aisle position of the storage and retrieval machine the carriage 6 may be driven in vertical directions to a position opposite a selected one of the storage racks 16 where the shuttle 8 is driven substantially in horizontal directions into and out of a storage rack to deliver or retrieve an object such as a box 24 shown in FIG. 1. The carriage 6 is driven by a motor 26 acting through a rotatable rope drum 28, both mounted on a frame 34 affixed to the base 2 and the mast 4, and driving the carriage 6 through a rope 30 reeved over a sheave 32 rotatably mounted at the upper end of the mast 4 and the rotatable drum 28. The carriage 6 includes a frame 46 upon which the shuttle 8 and a carriage brake 10 are mounted. The rope 30 is connected to the carriage brake 10 and thereby supports the carriage 6. As shown in FIG. 2, the carriage is guided in its upward and downward movement by the walls of the tube member 38 of the mast 4 by means of a plurality of guide rollers 114, 116 and 118, 120 rotatably mounted respectively on upper section 122 and lower section 124 of the frame 46, and guide rollers similar to rollers 114, 116, 118 and 120 mounted on the opposite side of the frame in engagement with the tube member 38 (not shown).

A control 36 is mounted on the base 2 for controlling the operation and movement to selected locations of the base 2, the carriage 6 and shuttle 8. Suitable means (not shown) is provided for supplying electrical power to the motors mounted on the base and carriage and control signals to the control 36.

Figure 3:
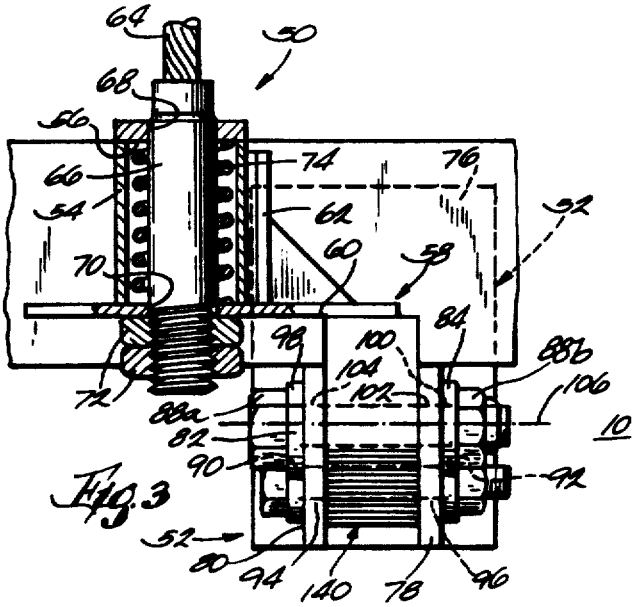
FIG. 3 is a front elevation view taken along lines 3—3 of FIG. 2.

With reference to FIGS. 2 and 3, the carriage brake includes an upper attachment plate 50 and an attachment bracket 52, both connected to a cross arm 48 of the carriage frame 46 by suitable means such as welding. A spring housing tube 54 abuts a bottom surface 56 of the attachment plate 50. An actuating member 58 is disposed horizontally and abuts the bottom end of the tube 54. The actuating member 58 includes a horizontal plate 60 and an upward extending guide arm 62 which is slideably movable against the tube 54. The rope 30 has an end 64 and a threaded clamp end 66 affixed to the rope end 64 by suitable means such as welding. The rope end 64 and clamp end 66 extend through an opening 68 in the attachment plate 50, through the tube 54, and through an opening 70 in the horizontal plate 60. The rope 30 and clamp end 66 are secured to the horizontal plate 58 by a pair of threaded nuts 72. The securing of the rope 30 to the plate 60 secures the rope to the carriage brake 10 and thereby affixes the end of the rope 64 to the carriage 6 and maintains the rope under tension due to the weight of the carriage. Resilient means such as a compression spring 74 is disposed in the tube 54 coaxially with the rope 30 and is held in a compressed condition by the upward force of the rope 30 against the weight of the carriage 6 supported by the rope. In the event of breakage of the rope, or if the rope goes slack for any reason such as jamming of the carriage as it travels downwardly on the mast 4, the weight of the carriage 6 will be released from the rope and thereby the compression spring is released from its compressed condition. Release of the spring 74 from its compressed condition causes the spring to expand in a downwardly direction away from the plate 50 to move the actuating member 58 in a downward direction.

The attachment bracket 52 includes a vertical plate 76 affixed to the frame arm 46 and a pair of horizontally projecting, spaced apart side plates 78 and 80 affixed to the vertical plate 76 and also the arm 48. A pair of brake cam adjustment plates 82 and 84 are attached to the side plates 78 and 80 by a bolt 86*a* and nut 86*b*, and a bolt 88*a* and nut 88*b*. The bolt 86*a* extends through openings 90 and 92 in plates 82 and 84 and through openings 94 and 96 in plates 80 and 78. The bolt 88*a* extends through openings 98 and 100 in adjustment plates 82 and 84 and through slotted openings 102 and 104 in side plates 78 and 80. A brake cam 140 is positioned in the space between the side plates 78 and 80 and mounted on the bolt 88*a*. The brake cam 140 has a slotted opening 142 through which the bolt 88*a* extends and the bolt 88*a* acts as a pivot pin having an axis 106, as can be seen in FIG. 3, about which the brake cam pivotally moves. As can be seen in FIG. 2, the brake cam 140 is positioned adjacent to a surface 108 of the mast tube 38 for pivotal movement toward and into engagement with the mast surface 108. A set screw 110 extends through the vertical plate 76 into engagement with the cam adjustment plate 82 for adjusting the position of the cam brake 140 relative to the mast surface 108. A bias spring 112 attached to the brake cam 140 and the side plate 80 applies tension to the brake cam 140 to maintain it spaced from the mast surface 108 during normal operation of the carriage 6.

Figure 4A:
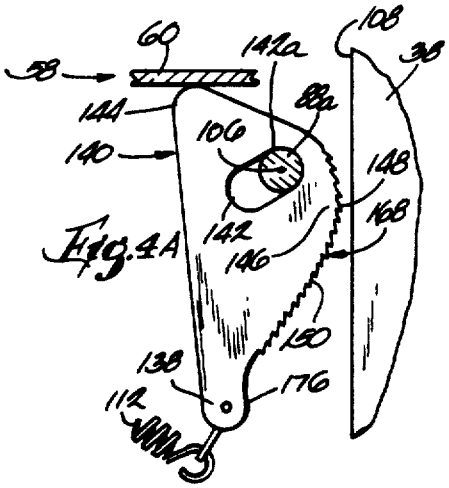
FIGS. 4A-D respectively illustrate four consecutive positions of the brake cam means according to the invention in which the cam is in its initial position out of engagement with the mast, at a beginning position in engagement with the mast, at an intermediate position in engagement with the mast, and at a final position in engagement with the mast.
Figure 4B:
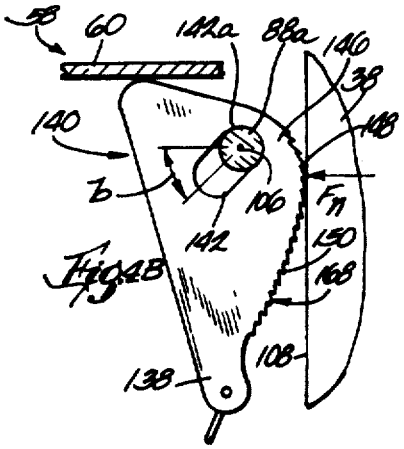
Figure 4C:
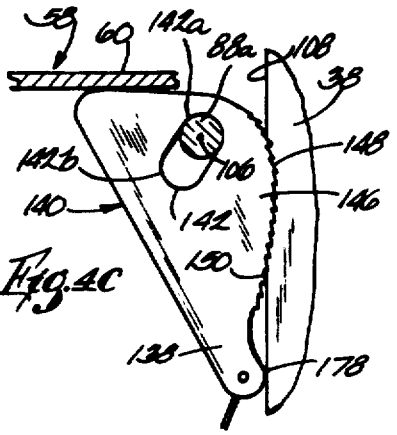
Figure 6:
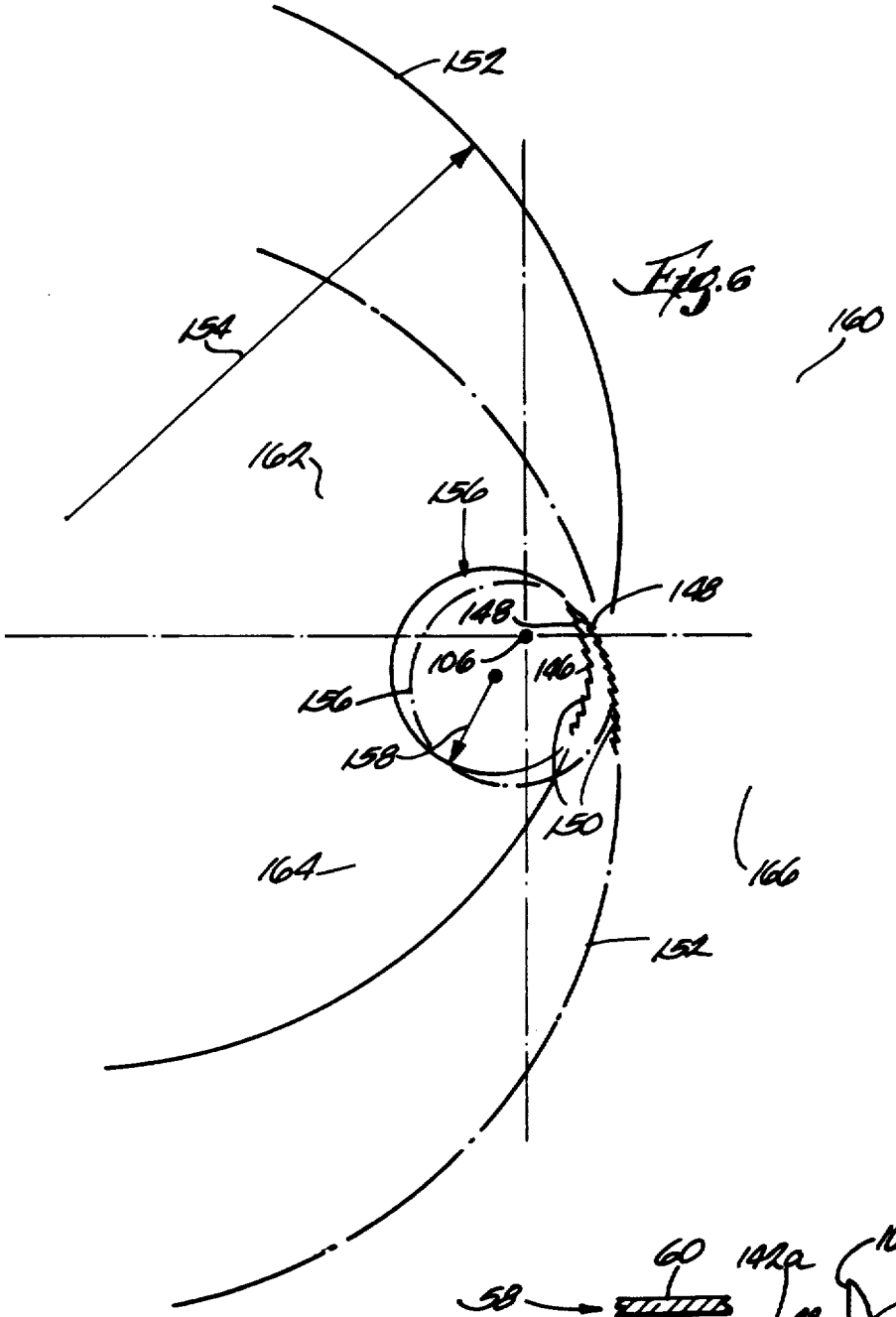
FIG. 6 is a schematic diagram illustrating the curvature sections of the brake cam.

With reference to FIGS. 2 and 4A, the brake cam 140 includes an actuating section 144 positioned in the path of movement of the actuating member 58, and a braking section 146 adjacent to and spaced from the surface 108 of the mast 4. The braking section 146 comprises a first curvature portion 148 and a second curvature portion 150. With reference to FIG. 6, which is a schematic diagram illustrating the location of the braking section 146, the second curvature portion 150 is shown lying along the circle 152 having a radius 154 and the first curvature portion is shown lying along the circle 156 having a radius 158 which is smaller than the radius 154 of the circle 152 and second curvature portion 150. The two circles 152 and 156 and thereby the first curvature portion 148 and second curvature portion 150 rotate about the pivot axis 106 from the initial position of the brake cam 140 as shown in FIG. 4A and as shown by the circles 152 and 156 in full lines in FIG. 6 to an intermediate position of the brake cam 140 in engagement with the mast surface 108 as shown in FIG. 4C and as shown by the position of the circles 152 and 156 in phantom lines in FIG. 6. The rotation as shown in FIG. 6 is through a portion of quadrants 160, 162, 164 and 166 which are positioned about the pivot axis 106. Since the center of the circle 156 is in the third quadrant 164 and the center of the circle 152 is in the second quadrant 162 at the start of rotation of the brake cam 140 and its first and second curvature portions 148 and 150, a large portion of the movement of the first curvature portion 148 will be horizontally toward the mast surface 108 whereas a large portion of the initial movement of the second curvature portion 150 will be vertically, approximately parallel with the mast surface 108, and also partially away from the mast surface. Thus, the first curvature portion 148 will move a larger distance toward the mast surface 108 an will the second curvature portion 150 during the initial pivotal movement of the brake cam 140 from the start position, as shown in FIG. 4A, to the initial mast contact position, as shown in FIG. 4B. Thus, the first curvature portion 148 is faster than the second curvature portion 150 in moving into engagement with the mast surface 108, i.e., the first curvature portion moves into engagement with the mast surface 108 in a smaller amount of time than the second curvature portion moves into engagement with the mast surface. The benefit of this aspect of the invention is to provide a faster reaction time of the carriage brake upon slacking of the rope 30 and extension of the spring 74. The smaller radius 158 of the circle 156 on which the first curvature portion lies permits a more compact brake cam 140.

Figure 7:
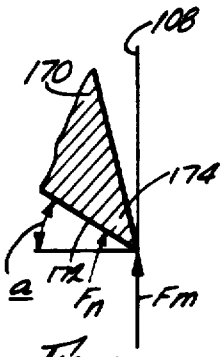
FIG. 7 is an enlarged side view illustrating one of the teeth of the brake cam of the invention.

With reference to FIG. 7, an enlarged side elevation view or profile of a cam tooth 170 of the plurality of cam teeth 168 is shown at an initial point of engagement with the mast surface 108. The tooth 170 includes a cutting surface 172 which is positioned when engaged with the mast surface 108 at the tooth tip 174 at an angle a with the horizontal of at least zero degrees and preferably greater than zero degrees. Also, in FIG. 7, the arrow $F_m$ represents the force of the mast surface on the tooth 170 as the brake cam 140 moves with the carriage along the mast surface 108 and the arrow $F_n$ represents the component of $F_m$ which is normal to the cutting surface 172 of the tooth 170. Where the angle a is equal to zero degrees, the normal force component of the mast on the cutting surface 172 will be in a direction such that it will not tend to move the tooth 170 away from the mast surface 108. Where the angle a has a value of greater than zero degrees, the force $F_n$ will have a direction partially toward the mast surface 108 and thereby will provide the tooth 170 with a self-engaging action against the mast surface. Thus, considering the entire plurality of teeth 168, as they engage the mast surface 108, the teeth will engage and tend to remain engaged with the mast surface 108 and will not bounce away or fail to cut into the surface to thereby brake the carriage.

In the operation of the carriage brake 10, if the rope 30 becomes slack due for example to breakage of the rope, the carriage 6 and thereby the carriage brake 10 will begin freely falling along the mast 4. At the same time, the slacking of the rope 30 releases tension in the rope and thereby releases the compressed spring 74 so that the spring expands downwardly against the actuating member 58. In response to the downward expansion of the spring 74, the actuating member 58 slides downward against the tube 54 along a path in which the actuating plate 58 engages the actuating section 144 of the brake cam 140. In response, the actuating section 144 also moves downward and causes the brake cam 140 to pivot about the bolt 88a and make an initial pivotal movement from the position shown in FIG. 4A out of engagement with the mast surface 4 to the position shown in FIG. 4B at which initial contact of the braking section 146 of the cam 140 is made with the mast surface 108. The first curvature portion 148 of the braking section moves more rapidly to make the initial contact with the mast surface 108 than the second curvature portion 150 due to the position of the first curvature portion on the circle 156 as previously described with reference to FIG. 6. As the compressed spring 74 continues to expand downwardly and move the actuating member 58 against the brake cam 140, the brake cam continues to pivot about the bolt 88a and move the second curvature portion 150 of the braking section 146 into engagement with the mast surface 108. The second curvature portion 150, due to its larger radius of curvature, brings a greater number of the teeth 168 into engagement with the mast surface 108 to provide increased braking action. Also, due to the component of the mast force $F_n$ acting on the teeth 168 in a direction toward the mast surface 108, as described with reference to FIG. 7, the teeth 168 remain in intimate contact with the surface 108 and create a self-engaging action in which they dig into the surface 108 to further increase the braking action as shown in FIG. 4C. At the position of engagement of the brake cam 140 with the mast surface 108 shown in FIG. 4C, the foot 138 at the lower end of the brake cam engages the mast surface 108 to prevent further pivoting of the brake cam about the bolt 88a to prevent decrease of the angle a and corresponding decrease in the force $F_n$ against the cam teeth cutting surfaces at the position of the brake cam 140 shown in FIG. 4C, the brake cam has reached its maximum pivotal movement distance about the bolt 88a toward the mast.

Figure 4D:
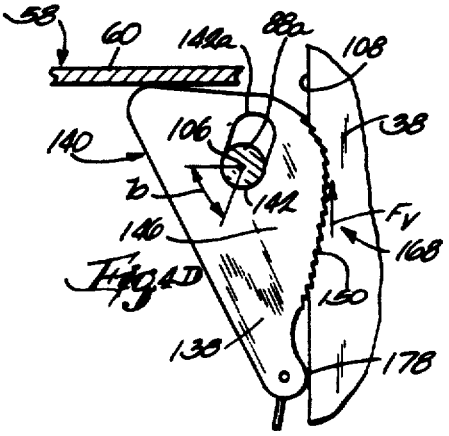
Figure 5:
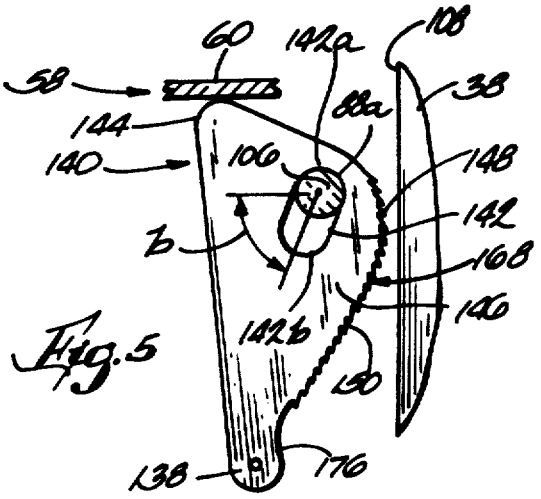
FIG. 5 illustrates the brake cam of an alternative embodiment of the invention.

With reference to FIG. 4A, and also FIG. 4B showing the initial contact of the brake cam 140 with the mast surface 108, the slot 142 in the brake cam 140 is positioned at an angle b with the horizontal which is less than 45 degrees. This position of the brake cam results in the horizontal force component $F_n$ of the force of the mast $F_m$ on the brake cam holding the cam against the bolt 88a in the position shown in FIGS. 4A and 4B in which the bolt 88a engages the slot 142 at the end 142a of the slot most adjacent the mast. However, with the angle b at a value greater than 45 degrees, as shown in FIGS. 4C and 4D, the vertical component $F_v$ of the force of the mast surface on the brake cam 140 dominates and slides the brake cam 140 upward along the slot 142 on the bolt 88a to the position of the cam 140 engaging the end 142b of the slot as shown in FIG. 4D. FIG. 4C shows the braking cam 140 at an intermediate sliding translation position as the cam 140 is moving upward on the bolt 88a toward the position as shown in FIG. 4D. As the cam slides upward on the bolt 88a to the position as shown in FIG. 4D, the brake cam 140 rotates about a pivot point 178 at the point of engagement of the foot 138 with the mast surface 108 in a rotation direction opposite to the pivoting motion of the cam 140 about the bolt 88a. Due to the upward sliding movement of the brake cam 140 and its rotation about the pivot point 178, the cam 140 is wedged against the mast surface 108 and the cam rotates to re-engage additional teeth 168 with the mast surface to increase the braking action. Although the angle b may be less than 45 degrees at the start position of the brake cam 140 as shown in FIG. 4A and increase to a value greater than 45 degrees as the cam 140 is pivoted about the bolt 88a so that the sliding movement of the cam on the bolt 88a occurs at a later position in the pivotal movement of the cam, it has been found that positioning the slot 142 at an angle greater than 45 degrees at the beginning position as shown in FIG. 5 is advantageous since it starts the sliding and wedging movement of the cam immediately upon the engagement of the braking section 146 of the cam with the mast surface 108. The sliding and wedging movement of the cam also provides self-adjustment to an effective braking position against the mast surface even though the mast may move somewhat away from the carriage brake 10 due to the force of the brake cam 140 against the mast surface 108.

It will be understood that the foregoing description of the present invention is for purposes of illustration only and that the invention is susceptible to a number of modifications or changes none of which entail any departure from the spirit and scope of the present invention as defined in the hereto appended claims.

What is claimed is:

1. In a storage and retrieval machine having a base movable along a path adjacent to vertically arranged storage locations, a vertical mast mounted on the base, carriage means movable in vertical directions on the mast for carrying objects to and from the storage locations, and drive means including a rope connected to the carriage under releasable tension for raising and lowering the carriage to and from positions adjacent storage locations, an improved carriage brake comprising:

a brake actuating member mounted on the carriage and movable along a predetermined path;

resilient means mounted on the carriage in engagement with the brake actuating member and responsive to release of tension of the rope to move the actuating member along the path;

brake cam means mounted on the carriage and having an actuating section in the path of the actuating member and a braking section adjacent to and spaced from the mast, the brake cam means being pivotally movable about an axis into engagement with the mast along the braking section in response to engagement of the actuating section with the actuating member as it moves along the path to apply braking force to the mast and brake the movement of the carriage;

the mast exerting an upward force against the brake cam means opposing the braking force;

the braking section has a plurality of teeth extending toward the mast, each tooth having a tip and a surface extending from the tip away from the mast, such surface defining an angle of greater than zero degrees above a horizontal plane, thereby resulting in a force urging such tooth toward the mast upon engagement with the mast; and the brake cam means includes a pivot pin coaxial with the axis about which the brake cam means pivots and extending through a slot disposed at an acute angle below horizontal when such cam means is in its normal position of repose, the slot being pivotally movable with the brake cam means toward the mast to increase the angle, the brake cam means being responsive to the force exerted by the mast at values of the angle greater than 45 degrees to slide on the pivot pin upwardly and toward the mast whereby the brake cam means is urged against the mast to increase the braking action of the brake cam means.

2. The carriage brake according to claim 1 wherein the braking section has a first curvature portion and a second curvature portion, the first curvature portion being positioned relative to the axis such that, during initial pivotal movement of the brake cam means, the first curvature portion moves a distance toward the mast greater than the distance moved by the second curvature portion.

3. The carriage brake according to claim 2 wherein the first curvature portion is that curvature portion to first engage the mast during braking and wherein the first and second curvature portions each have a radius of curvature, that of the first curvature portion being smaller than that of the second curvature portion.

4. The carriage brake according to claim 2 wherein:

the brake cam means has a maximum pivotal movement distance toward the mast;

the brake cam means includes a lower end and a foot at the lower end, the foot having a position in engagement with the mast at the maximum pivotal movement distance of the brake cam means and thereby determines such maximum pivotal movement distance; and the angle of the slot is greater than 45 degrees with the horizontal when the foot is in said mast engagement position.

5. In a storage and retrieval machine having a base movable along a path adjacent to vertically arranged storage locations, a vertical mast mounted on the base, carriage means movable in vertical directions on the mast for carrying objects to and from the storage locations, and drive means including a rope connected to the carriage under releasable tension for raising and lowering the carriage to and from positions adjacent storage locations, an improved carriage brake comprising:

a brake actuating member mounted on the carriage and movable along a predetermined path;

resilient means mounted on the carriage in engagement with the brake actuating member and responsive to release of tension of the rope to move the actuating member along the path;

brake cam means mounted on the carriage and having an actuating section in the path of the actuating member and a braking section adjacent to and spaced from the mast, the cam means being pivotally moveable about an axis toward and into engagement with the mast along the braking section in response to engagement of the actuating section with the actuating member as it moves along the path to brake the movement of the carriage; and the braking section has a first curvature portion for initiating braking action and imparting further cam rotation and a second curvature portion for increased braking action, the first curvature portion being positioned relative to the axis such that, during initial pivotal movement of the brake cam means, the first curvature portion moves a distance toward the mast greater than the distance moved by the second curvature portion and the first curvature portion moves into engagement with the mast.

6. The carriage brake according to claim 5 further comprising:

first, second, third and fourth quadrants of rotation positioned about the brake cam means pivot axis;

the brake cam means pivotally moves in a first rotational direction;

the first curvature portion lies along a circle having a center in the third quadrant during initial pivotal movement of the brake cam means toward the mast whereby the movement of the first curvature portion during the initial movement of the cam means is toward the mast; and the second curvature portion lies along a circle having a center in the second quadrant during initial movement of the brake cam means toward the mast whereby the movement of the second curvature portion during initial movement of the cam means includes a movement portion away from the mast.

7. The carriage brake according to claim 5 or 6 wherein:

the second curvature portion has a number of teeth greater than that of the first plurality of teeth; and the second curvature portion is movable during intermediate pivotal movement of the brake cam means into engagement with the mast along the second plurality of teeth whereby the larger number of teeth of said plurality of teeth increases the braking force on the mast.

8. The carriage brake according to claim 7 wherein the first and second curvature positions each have a radius, the radius of the first curvature portion being smaller than the radius of the second curvature portion.

9. In a storage and retrieval machine having a base movable along a path adjacent to vertically arranged storage locations, a vertical mast mounted on the base, carriage means movable in vertical directions on the mast for carrying objects to and from the storage locations, and drive means including a rope connected to the carriage under releasable tension in the event of breakage of the rope or jamming of the carriage movement for raising and lowering the carriage to and from positions adjacent the storage locations, a carriage brake comprising:

a brake actuating member mounted on the carriage and movable along a predetermined path;

resilient means mounted on the carriage in engagement with the brake actuating member and responsive to release of tension on the rope to move the actuating member along the path;

brake cam means mounted on the carriage and having an actuating section in the path of the actuating member and a braking section adjacent to and spaced from the mast, the brake cam means including a pivot pin about which the brake cam means is pivotally movable toward and into engagement with the mast along the braking section in response to engagement of the actuating section with the actuating member as it moves along the path to apply braking force to the mast and brake the movement of the carriage;

the mast exerts an upward force against the brake cam means and in opposition to the braking force; and the brake cam means includes a slot which, when such cam means is in its normal position of repose, is disposed at an angle below the horizontal and through which the pivot pin extends, the slot being pivotally movable with the brake cam means toward the mast to increase the angle, the brake cam means being responsive to the vertical component of the force of the mast on the brake cam means at values of the angle greater than 45 degrees to slide on the pivot pin along the slot upwardly toward the mast whereby the brake cam means is urged against the mast to increase the braking action of the brake cam means.

10. The carriage brake according to claim 9 wherein:

the brake cam means has a maximum pivotal movement distance about the pivot pin toward the mast;

the brake cam means includes a lower end and a foot at the lower end, the foot having a position in engagement with the mast at the maximum pivotal movement distance of the brake cam means whereby said distance is determined by the position of the foot; and the angle of the slot is greater than 45 degrees with the horizontal when the foot is in said mast engagement position.

11. The carriage brake according to claim 10 wherein the brake cam means is pivotal about the mast engagement position of the foot toward the mast during upward sliding movement of the brake cam means on the pivot pin, the pivotal movement about the mast engagement position of the foot being in an opposite rotational direction than the pivotal movement of the brake cam means about the pivot pin.

12. The carriage brake according to claims 9, 10 or 11 wherein:

the brake cam means has an initial position spaced from the mast and the slot has an end adjacent the mast engaging the pivot pin when the brake cam means is in the initial position; and the brake cam means is responsive to the horizontal component of the force of the mast on the brake cam at values of the angle less than 45 degrees to maintain the end of the slot in engagement with the pivot pin as the brake cam means pivotally moves toward the mast.

* * * * *